US008899862B2

(12) United States Patent
Korper et al.

(10) Patent No.: US 8,899,862 B2
(45) Date of Patent: Dec. 2, 2014

(54) WIDE AREA COATING APPLICATOR

(71) Applicant: SKM Industries, Inc., Olyphant, PA (US)

(72) Inventors: George Korper, Mill Spring, NC (US); Stephen Krisanda, Olyphant, PA (US)

(73) Assignee: SKM Industries, Inc., Olyphant, PA (US)

( * ) Notice: Subject to any disclaimer, the term of this patent is extended or adjusted under 35 U.S.C. 154(b) by 218 days.

(21) Appl. No.: 13/660,514

(22) Filed: Oct. 25, 2012

(65) Prior Publication Data

US 2014/0119808 A1 May 1, 2014

(51) Int. Cl.

| | |
|---|---|
| ***B43K 1/04*** | (2006.01) |
| ***B43K 29/013*** | (2006.01) |
| ***B43K 8/08*** | (2006.01) |
| ***B43K 8/12*** | (2006.01) |
| ***B43K 27/08*** | (2006.01) |

(52) U.S. Cl.
USPC ..... 401/199; 401/195; 401/207

(58) Field of Classification Search
CPC ..... B43K 1/04; B43K 8/08; B43K 8/12; B43K 27/08; B43K 29/013; B43K 29/04
USPC ..... 401/18, 36, 37, 195, 199, 206, 207, 261
See application file for complete search history.

(56) References Cited

U.S. PATENT DOCUMENTS

| | | | | |
|---|---|---|---|---|
| 1,857,467 | A | 5/1932 | Marsh | |
| 2,330,053 | A | 9/1943 | Herb | |
| 3,468,611 | A | 9/1969 | Ward | |
| 4,783,185 | A * | 11/1988 | Erismann et al. | 401/37 |
| 4,983,061 | A * | 1/1991 | Demarest | 401/148 |
| 5,073,058 | A | 12/1991 | Fukuoka et al. | |
| 5,387,046 | A | 2/1995 | Danno | |
| 5,651,627 | A * | 7/1997 | Dowzall et al. | 401/199 |
| 5,813,787 | A * | 9/1998 | Dowzall et al. | 401/199 |
| 6,634,821 | B2 | 10/2003 | Gueret | |
| 6,641,320 | B1 | 11/2003 | Ballot | |
| 6,682,246 | B2 * | 1/2004 | Reggiani | 401/264 |
| 6,817,801 | B1 | 11/2004 | Colburn | |
| 7,101,105 | B2 | 9/2006 | Reggiani | |
| 7,377,710 | B2 * | 5/2008 | Baumann et al. | 401/266 |
| 7,878,727 | B2 * | 2/2011 | Koptis | 401/126 |
| 7,988,376 | B2 * | 8/2011 | Todd | 401/186 |
| 2008/0145136 | A1 | 6/2008 | Korper | |
| 2011/0013966 | A1 | 1/2011 | Ballot | |

* cited by examiner

*Primary Examiner* — David Walczak
*Assistant Examiner* — Joshua Wiljanen
(74) *Attorney, Agent, or Firm* — Notaro, Michalos & Zaccaria P.C.

(57) ABSTRACT

An applicator has reservoir for fluid and a supply passage. A valve in the passage has a seat and a member movable between closed and open positions. A spring biases the member toward its closed position. An elongated nib is mounted in the supply passage and has an end extending from the passage, the nib engaging the member so that the member moves to its open position. An adapter has a portion for holding a pad that has at least one dimension elongated transversely to the nib. The adapter includes an engagement portion with a cavity for detachably receiving an end of the reservoir, the cavity having a depth so that it engages the nib when the end of the reservoir is detachably received in the cavity to apply pressure on the nib to move the member to its open position.

20 Claims, 3 Drawing Sheets

FIG. 2
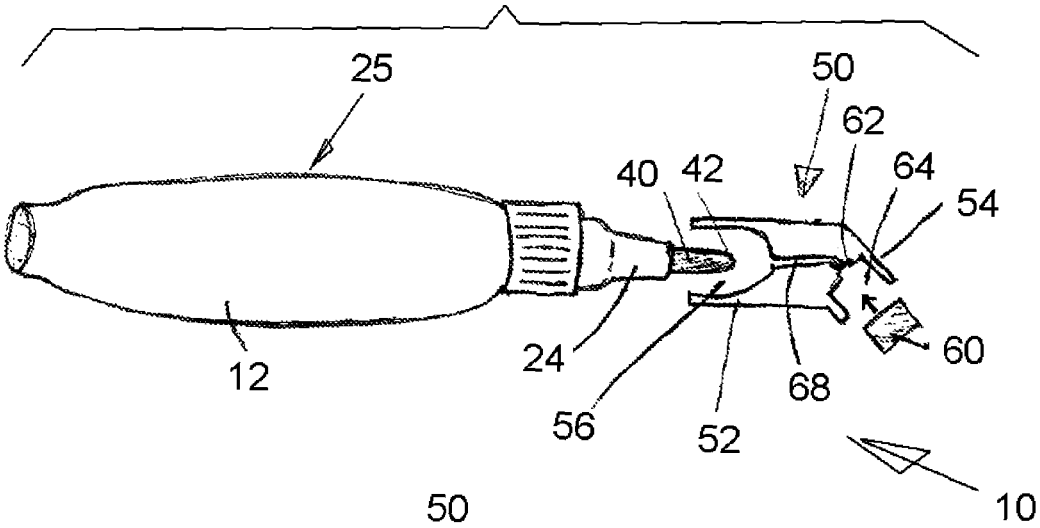
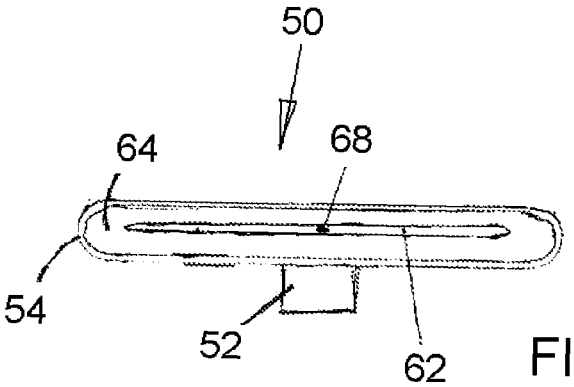
FIG. 3

WIDE AREA COATING APPLICATOR

FIELD AND BACKGROUND OF THE INVENTION

The present invention relates generally to the field of coating and marking tools, and in particular to a new and useful wide area applicator for coating fluids.

Various types of hand-held applicator devices have been devised for holding, dispensing and spreading liquids. These devices include fountain pens, ball point pens, felt tip pens, "magic" marker pens, paint pens, stain-remover pens, paint rollers, and spray cans, among others. Some of these fluid applicator devices are used for dispensing fluids such as inks, paints, dyes, polishes, chemicals, glues, lubricants, perfumes, leather treatments, glass treatments and sealants, and cleaning products.

The fluid applicator devices of the prior art have received wide acceptance due in great measure to the convenience of the devices. The fluid applicator devices of the prior art have the ability to hold varying quantities of applicator fluid, and the ability to supply applicator fluid from a fluid reservoir to an applicator tip at the discretion of the user. Fluid applicator devices can be adapted to dispense a wide variety of fluid and other flowing materials.

There are a number of fluid applicator devices currently known that outwardly resemble "magic marker" type marker pens. In one common embodiment, applicator liquid flows to a fiber applicator tip only when the liquid applicator device is held upside down and the fiber applicator tip is depressed by a surface to be coated by the applicator fluid. This process, in some embodiments, resembles and is similar to writing on a flat surface using the tip of a magic marker. U.S. Patent Application 2011/0013966 by Ballott provides an example of a such a device, and includes a discussion of various liquid applicator designs. That application and its general discussion of liquid applicators are incorporated by reference herein by way of background.

Marker-pen type fluid applicators typically comprise a tube or a hollow body, which may be either rigid or made from a squeezable material. The tube or body is normally adapted both as a means for users to hold the applicator device, and as a reservoir of the fluid to be applied. Often the marker has a tip or nib that can be pushed inwards when the marker is pressed against a surface to be coated, the motion of the tip towards the reservoir body pushing open a valve that is typically biased in a closed position by a spring or other resilient means.

In many examples, these markers only dispense fluid when they are held tip-down, when the body holding the liquid is squeezed, and/or when the tip of the marker is pressed inwardly so as to open an internal valve releasing liquid. These markers often rely on gravity or pressure to allow fluid to pass into contact with a small nib or other application component. The nib or other application component is often acrylic, polyester, felt, or another porous application material.

Marker-type fluid applicators normally have small application surfaces, typically nibs ranging from 1-6 mm, and are not well adapted for coating larger surface areas. "Jumbo" markers are sold to cover somewhat wider areas, but such markers are still not well suited to evenly and quickly covering areas of, for example, several square feet. At the same time, "Jumbo" markers are also unsuited for small surfaces.

Means such as paint brushes and paint rollers can be used to cover larger surfaces with various liquids. These systems are not self-contained, however, and require a separate reservoir to hold the liquid. Paint brushes and paint rollers also require the extra step of repeatedly dipping the application surface in the liquid reservoir, and are prone to accidentally dripping liquids.

Spray cans and aerosol propellant systems are self-contained but are often imprecise, usually cannot be refilled by the consumer, and may create unpleasant and unhealthy fumes.

Thus, it is desirable to have a self-contained marker-pen type fluid dispenser that may be adapted to cover either very small areas, or areas of several square feet or more. Alternatively, an attachment that can be removably affixed to a variety of fluid dispensers, such as different marker-type dispensers, to increase the effective application surface area of the dispensers would be useful.

SUMMARY OF THE INVENTION

The instant invention embodies an improvement over prior art fluid applicators. A preferred embodiment includes a wide-area attachment or adapter that fits over the dispensing (i.e., "writing") end of a marker-type fluid applicator in place of a cap. The adapter may be designed to hold a large felt or fiber pad that is useful for covering large areas. The application pad is preferably removable, as is the wide-area attachment itself. When necessary, the attachment can be adapted so that it depresses a nib in an applicator when affixed to the applicator, simultaneously opening the applicator valve and channeling fluid from the applicator to the large pad of the wide-area adapter.

In the preferred embodiment the user need only remove the cap from a marker-pen type applicator and replace it with the wide-area adapter to commence application. This provides a novel advantage over previous applicators because it is able to convert a normal marker-pen applicator, having a small application surface intended for drawing lines, into a wider applicator that can cover large areas. Thus, consumers can conveniently use the same applicator to apply liquid to small targeted areas, or to large surfaces, merely by removing a cap and replacing it with the wide area adapter. Preferably a single adapter attachment can be switched between a variety of applicators, thus providing additional cost and convenience advantages.

It is an object of the present invention to provide a device that can store a quantity of fluid, selectably dispense fluid, and conveniently and evenly coat large surfaces with such fluid.

Preferably, the device allows a single liquid applicator to be switched between wide area and narrow area configurations by attaching and removing a wide-area adapters having a relatively wide applicator surface.

Preferably, a single a wide-area adapter can be used with and quickly switched between different liquid applicators.

Preferably, the wide-area adapter is easily added and removed from liquid applicators in a manner similar to adding and removing a cap to a marker or a pen.

Preferably, the fluid applicator can be held in a manner similar to a marker or a pen.

Preferably, the fluid applicator includes a reservoir for holding fluid, and that reservoir can be conveniently accessed for cleaning and filling.

Preferably, the fluid applicator includes a valve that is biased in the closed position, safely sealing liquids in the applicator when it is not in use, and the valve is only opened when a nib on the applicator is deliberately pressed inwards.

Preferably, the wide-area adapter depresses the nib when it is engaged to the fluid applicator, thus maintaining the applicator valve in the open position so that liquid can flow into the wide-area adapter.

Preferably, the wide-area adapter provides a fluid application surface that is much wider than the application surface of the fluid applicator alone.

Preferably, the wide-area applicator includes a wide porous applicator surface that is inexpensive and disposable and/or that can be easily cleaned between uses.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is a sectional view of the wide area adapter, the section depicted as line 2-2 in FIG. 1, coupled with a standard side view of an assembled liquid applicator; and FIG. 3 is a front view of the wide-area adapter attachment with the porous pad removed so as to expose the inside of the porous pad chamber, the fluid distribution chamber, and the opening of the housing passage into the fluid distribution chamber.

DESCRIPTION OF THE PREFERRED EMBODIMENTS

Figure 1:
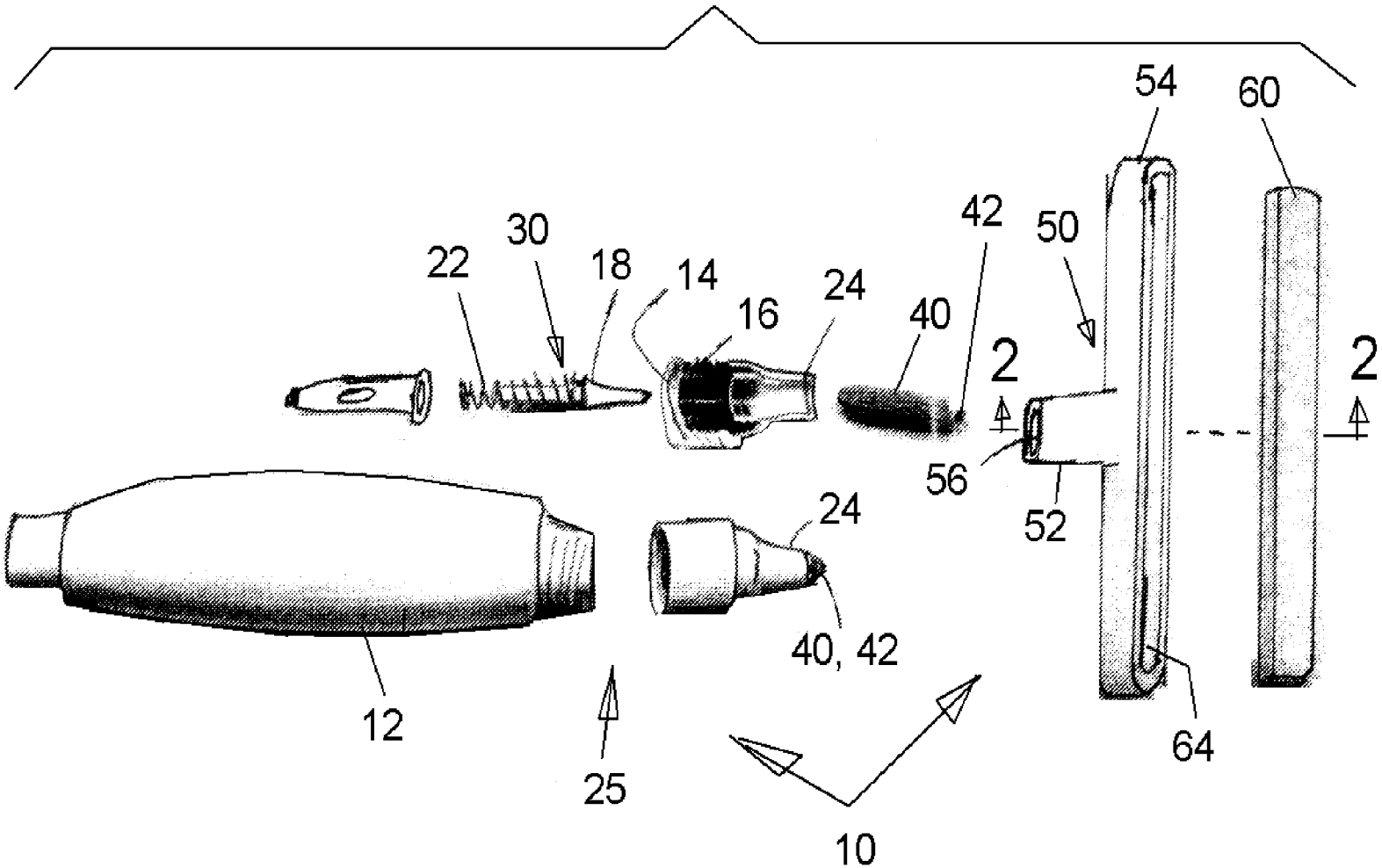
FIG. 1 is a partially exploded, partially sectional view of a partially disassembled wide area applicator device of the invention, with portions appearing more than once for clarity.
Figure 4:
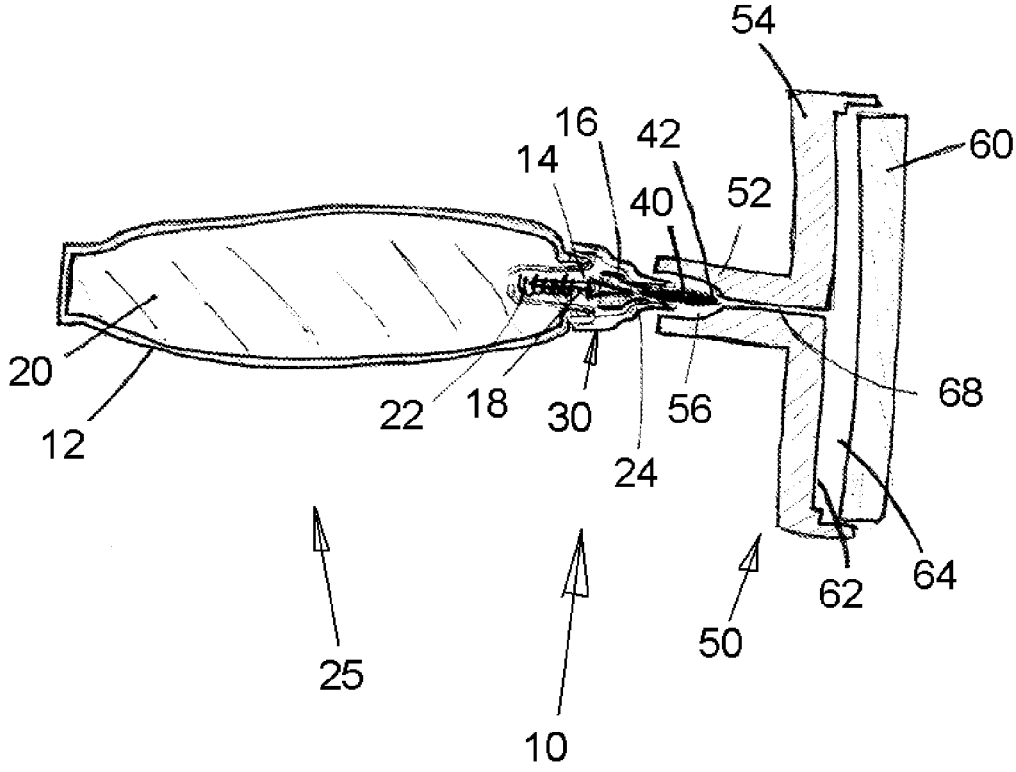
FIG. 4 is a top sectional view of a wide area applicator.

Referring now to the drawings, in which like reference numerals are used to refer to the same or similar elements, FIG. 1 shows a preferred embodiment of the wide area applicator 10 for applying a coating fluid. The wide area applicator 10 comprises a base applicator 25 joined to and together with a wide area adapter 50.

A reservoir 12, end portion 24, nib 40, and valve assembly 30, exclusive of the wide area adapter 50, which may collectively resemble a marker pen with the cap removed, are collectively referred to as a base applicator 25.

The base applicator 25 comprises the reservoir 12 adapted to contain a supply of coating fluid 20 and for holding the assembly, the reservoir opening into a supply passage 14 for supplying a flow of the coating fluid leaving the reservoir 12, the supply passage leading to an end portion 24. A valve assembly 30 may be present in the supply passage 14 of the base applicator 25, the valve assembly comprising a valve seat 16 for selectably passing coating fluid, and a valve member 18 movable between a closed position engaged closely to the valve seat 16 to block a flow of fluid 20, and an open position, with space between the valve member and the valve seat allowing for coating fluid to pass through the valve seat 16. The valve assembly 30 includes a spring 22 for biasing the valve member 18 toward its closed position engaged to the valve seat 16 to block the flow of coating fluid 20.

An elongated porous nib 40 is movably mounted in the supply passage 14 with an end 42 of the nib extending out of the end portion 24 of the base applicator 25. The nib is preferably capable of functioning as a fluid applicator surface. The nib 40 is engaged with the valve member 18 so that when a pressure is exerted on the end 42 of the nib, in a direction toward the reservoir 12, the valve member 18 is moved to its open position away from the valve seat 16 to allow fluid to pass through the valve seat 16 and the supply passage 14.

A wide area adapter 50 is preferably an attachment having a wide holder portion 54 adapted for holding a porous pad 60 that has at least one dimension that is elongated transverse to the elongated porous nib 40. A porous pad 60 is removably held in the holding portion 54 within a porous pad chamber 64. See also FIG. 3, showing a front view of the wide area adapter 50 with the porous pad 60 removed.

The wide area adapter 50 includes an engagement portion 52 with a cavity 56 for detachably receiving the end portion 24 of the base applicator 25. The engagement portion 52 (also depicted at FIG. 2) may engage with the end portion 24 in a number of ways including, for example, snapping-on, screw-on threads, tape, or adhesives.

The cavity 56 preferably has a depth selected so that an inner surface of the cavity engages the end 42 of the nib 40 when the end portion 24 of the base applicator 25 is received in the cavity 56. The inner surface of the cavity 56 preferably applies pressure on the end 42 of the nib so as to move and hold the valve member 18 is its open position.

The porous pad chamber 64 of the wide area adapter 50 is adapted for receiving and holding the porous pad 60. A fluid distribution chamber 62, optionally resembling a channel or canal, extends along and communicates with the porous pad chamber 64. A housing passage 68 communicates between the cavity 56 and one or more fluid distribution chambers 62, so that fluid from the reservoir 12 passes through supply passage 14, the cavity 56 and a fluid distribution chamber 62, to enter the porous pad chamber 64 to soak the porous pad 60 for applying the fluid along a wide area, using the porous pad 60.

The preferred embodiments of FIGS. 1-3 are made from plastic with the exception of the porous pad 60 which is made from felt.

The present invention includes both fully constituted wide area applicators 10 as shown in FIGS. 1-2, comprising both wide applicators and fluid reservoirs, as well as wide area adapter 50 attachments in isolation, as exemplified in FIG. 3, which can be used interchangeably with various fluid applicators.

The wide area adapter 50 attachments of the present invention can be used with a wide variety of fluid applicators and fluid reservoirs. The base applicator 25 described in the preferred embodiment is only one of many of many possible fluid applicators, and persons of skill in the art will recognize that the wide area adapters 50 as presently disclosed may be adapted for use with most fluid applicator types.

For example, the prior art includes a number of pen or marker-like fluid applicators that only dispense fluid when they are held tip-down, when the body holding the fluid is squeezed, and/or when the tip of the marker is pressed inwardly so as to open an internal valve releasing fluid. These applicators often rely on gravity or pressure to allow fluid to pass into contact with a small nib or other application component. Such marker-like base applicators may employ a wide variety of valve mechanisms to control the flow of fluid, or may not include a valve at all. Non-limiting examples of liquid applicators that might be used in conjunction with an embodiment of the present invention are described in U.S. Pat. No. 1,857,467, U.S. Pat. No. 2,330,053, U.S. Pat. No. 3,468,611, U.S. Pat. No. 5,073,058, U.S. Pat. No. 5,387,046, and U.S. Pat. No. 6,641,320.

It will be appreciated that liquid applicators and liquid reservoirs that do not resemble markers or other writing devices may also be used with the wide area adapter attachments of the present invention. Non-limiting examples include resilient, squeezable plastic bottles, containers resembling toothpaste tubes, and hard metal cans. Fluid applicators for use with this invention may comprise a variety of materials including, for example, plastics and metals.

In a preferred embodiment, the fluid applicator comprises a reservoir 12 that can be opened at one or more ends, such as by a screw-on cap, for refilling with application fluid and for cleaning.

The shape and dimensions of the cavity 56 and engagement portion 52 may be varied and adjusted to receive and attach to end portions 24 and base applicators 25 of different shapes and sizes. The cavity may include threading, ridges, dimples, or other adaptations to interface with different end portions 24. The cavity is preferably shaped so as to better interface with and depress the nib 40, 42 so that the nib does not interfere with the flow of fluid into the housing passage 68. The cavity may be shaped to accommodate fluid flowing into the housing passage 68.

In one alternative embodiment, the engagement portion 52 may be detached from the wide area adapter 50 and replaced with different engagement portions 52 having a cavities 26 having various shapes and sizes to receive various different end portions 24. This allows a single wide area adapter 50 unit to be fitted to fluid applicators and base applicators 25 of varying shapes and sizes.

Optionally, more than one housing passage 68 may connect the cavity 56 to the fluid distribution chamber 62.

Preferably, but without limiting the scope of the invention, the holder portion 54 of the wide area adapter 50, the porous pad chamber 64, and the porous pad 60 are all substantially the same shape. In a particularly preferred embodiment, depicted in FIGS. 1 and 3, the holder portion, porous pad chamber, and the porous chamber are elongated rectangles with rounded ends approximately three inches wide. It will be appreciated, however, that these elements can all take a wide variety of sizes and shapes including, without limitation, squares, rectangles, circles, triangles, ovals, and/or bars. Different sizes and shapes may be employed for applying fluids to different surfaces.

In a preferred embodiment, depicted in FIG. 3, the fluid distribution chamber 62 is a single channel that extends along the length of and communicates with the porous pad chamber 64. The fluid distribution chamber may, however, be any open space that is near, but that is not substantially occupied by, part of the porous pad 60. As a result, fluid to be applied can move unimpeded within the fluid distribution chamber to reach various parts of the porous pad 60 in the porous pad chamber 64. Persons of skill in the art will appreciate that fluid distribution chambers 62 with other shapes, volumes, and patterns can be employed to channel fluid to porous pads of varying shapes and sizes. For example, fluid distribution chambers 62 might take the form of channels in an "X" pattern, an asterisk pattern, parallel lines, or a grid pattern in order to wet porous pads having square or circular shapes. The fluid distribution chamber 62 may be quite shallow, or may have significant depth and volume.

Alternatively, it would be possible to design a wide area adapter 50 within the scope of this invention that does not include any fluid distribution chamber 62. This could be accomplished, for example, by employing a plurality of housing passages 68 to deliver fluid directly to different parts of the porous pad chamber 64 and porous pad 60.

In a preferred embodiment, the height of the porous pad 60 is slightly greater than the depth of the porous pad chamber 64 so that the porous pad extends slightly above and outside of the chamber 64 when the pad 60 is seated all the way into the chamber 64. In this arrangement, the porous pad is held securely in the porous pad chamber 64 while still leaving a small portion of the porous pad outside the chamber to make contact with a surface to be covered in fluid.

Optionally, the porous pad can be attached to the wide area adapter, such as by hook and loop fasteners or using buttons.

It is possible to design a wide area adapter 50 within the scope of this invention that does not include a porous pad chamber 64. For example, the porous pad could be affixed on only one side to the surface of a holder portion 54 using hook and loop fasteners. A fluid distribution chamber 62 and/or housing passages 68 could be adapted to bring fluid directly to the attached surface of the porous pad 60 that is in contact with the holder portion 54, wetting the porous pad with the fluid to be applied.

Preferably the porous pad 60 is easily removable from the porous pad chamber 64. Preferably the porous pad is inexpensive and disposable and/or is easily washable. The porous pad may be made from materials including, for example, filtrona wick, acrylic, polyester, felt, plastic, cotton, cellulose, or another porous material.

The wide area adapter 50 can be made using variety of rigid and/or resilient materials including, for example, plastics, metals, rubber, or wood. Preferably the wide area adapter comprises materials that are easy to clean, non-corroding, and that will not stick to or interact with the liquid(s) to be applied.

The terms "liquid" and "fluid" are used interchangeably, and should be considered as equivalent.

While a specific embodiment of the invention has been shown and described in detail to illustrate the application of the principles of the invention, it will be understood that the invention may be embodied otherwise without departing from such principles.

What is claimed is:

1. A wide area applicator (10) for applying a coating fluid, comprising:

a base applicator (25) comprising a reservoir (12) adapted to contain a supply of coating fluid, the reservoir connecting to a supply passage (14) for supplying a flow of the coating fluid to an end portion (24);

a valve assembly (30) in the supply passage (14), the valve assembly having a valve seat (16) for passing coating fluid and a valve member (18) movable between a closed position engaging the valve seat (16) so as to block the flow of fluid, and an open position allowing coating fluid to pass through the valve seat, the valve assembly (30) comprising a resilient means for biasing the valve member (18) toward the closed position;

an elongated porous nib (40) mounted for movement in the supply passage (14) with an end (42) of the nib (40) extending out of the end portion (24) of the base applicator (25), the nib being engaged with the valve assembly (30) so that when a pressure is exerted on the end (42) of the nib, in a direction toward the reservoir (12), the valve assembly is moved to its open position to allow fluid to pass through the valve seat (16) and the supply passage (14); and a wide area adapter (50) having a holder portion (54) for holding a porous pad (60) that has at least one dimension that is elongated transverse to the elongated porous nib (40), with a porous pad (60) held in the holding portion (54), the wide area adapter (50) including an engagement portion (52) with a cavity (56) for detachably receiving the end portion of the base applicator, the cavity (56) having a depth selected so that an inner surface of the cavity engages the end (42) of the nib to apply a pressure on the end of the nib to move the valve assembly (30) to its open position when the end portion (24) of the base applicator (25) is detachably received in the cavity (56);

the wide area adapter (50) having a porous pad chamber (64) for receiving and holding the porous pad (60), a fluid distribution chamber (62) extending along and communicating with the porous pad chamber (64), and a housing passage (68) communicating between the cavity (56) and the fluid distribution chamber (62), so that fluid from the reservoir (12) passes through the supply passage (14), the cavity (56), and the a fluid distribution chamber (62), to enter the porous pad chamber (64) to soak the porous pad (60) for applying the fluid along a wide area, using the porous pad.

2. The wide area applicator as claimed in claim 1, wherein the porous pad and the holder portion both have the shape of an elongated rectangle with rounded ends.

3. The wide area applicator as claimed in claim 1, wherein the porous pad has a height, width, and depth, and wherein the porous pad has an elongated shape such that the length of the pad's greatest dimension is at least four times the length of the pad's second greatest dimension.

4. The wide area applicator as claimed in claim 1, wherein the end portion is removably attached to the reservoir, and wherein the reservoir is adapted for separation from the other components of the wide area applicator to facilitate refilling the reservoir with coating fluid.

5. The wide area applicator as claimed in claim 4, wherein the end portion of the base applicator is removably attached to the reservoir using a threaded screw-on configuration.

6. The wide area applicator as claimed in claim 1, wherein the porous pad comprises a strip of felt that has a length of at least two inches, and a height and depth of no more than one half of one inch each at any point.

7. A wide area adapter for applying a fluid and for removably coupled with a fluid applicator having a fluid reservoir, the wide area adapter comprising:

a holder portion for holding a porous pad, the holder portion having at least one dimension that is elongated, with a porous pad held in the holder portion;

an engagement portion with a cavity adapted for detachably receiving a portion of the fluid applicator;

a porous pad chamber for receiving and holding the porous pad;

a fluid distribution chamber communicating with the porous pad chamber; and a housing passage communicating between the cavity and the fluid distribution chamber;

the wide area adapter being adapted to receive fluid from a coupled fluid applicator such that fluid leaving the fluid applicator may enter the cavity, the fluid thence passing into and through the housing passage, thence into the fluid distribution chamber, and finally into a porous pad chamber to soak the porous pad for applying the fluid along a wide area, using the porous pad;

wherein the wide area adapter is removably coupled with a fluid applicator, the fluid applicator comprising a fluid reservoir and a nib.

8. The wide area adapter as claimed in claim 7, wherein the porous pad has an elongated rectangular shape.

9. The wide area adapter as claimed in claim 7, wherein the porous pad has a height, width, and depth, and wherein the porous pad has an elongated shape such that the length of the pad's greatest dimension is at least five times the length of the pad's second greatest dimension.

10. The wide area adapter as claimed in claim 7, wherein the fluid applicator comprises an end portion which is removably attached to the reservoir, and wherein the reservoir is adapted for separation from the end portion to facilitate refilling the reservoir with coating fluid.

11. The wide area adapter as claimed in claim 7, wherein the porous pad comprises a strip of felt that has a length of at least two inches, and a height and depth of no more than one half of one inch each at any point.

12. The wide area adapter as claimed in claim 7, wherein said fluid applicator comprises a valve assembly for controlling the release of fluid, the valve assembly being biased towards a closed position.

13. The wide area adapter as claimed in claim 7, wherein said fluid applicator comprises a valve assembly for controlling the release of fluid, wherein the valve assembly is biased towards a closed position by a coiled spring, and wherein the valve assembly is reversibly held in an open position against the force of the coiled spring by pressure of the engagement portion cavity of the wide area adapter on the nib of the fluid applicator.

14. The wide area adapter as claimed in claim 7, wherein the nib is mounted for movement in a supply passage (14) with an end (42) of the nib (40) extending out of an end portion (24) of the base applicator (25), the nib being engaged with a valve assembly (30) so that when a pressure is exerted on the end (42) of the nib the valve assembly is moved to its open position to allow fluid to pass through a valve seat (16) and a supply passage (14).

15. A wide area adapter for applying a fluid and removably coupled with a fluid applicator having a fluid reservoir, the wide area adapter comprising:

a holder portion for holding a porous pad, the holder portion having at least one dimension that is elongated, with a porous pad held in the holder portion;

an engagement portion with a cavity adapted for detachably receiving a portion of the fluid applicator;

a porous pad chamber for receiving and holding the porous pad;

a fluid distribution chamber communicating with the porous pad chamber; and a housing passage communicating between the cavity and the fluid distribution chamber;

the wide area adapter being adapted to receive fluid from the coupled fluid applicator such that fluid leaving the fluid applicator may enter the cavity, the fluid thence passing into and through the housing passage, thence into the fluid distribution chamber, and finally into a porous pad chamber to soak the porous pad for applying the fluid along a wide area, using the porous pad;

wherein the wide area adapter is removably coupled with the fluid applicator, the fluid applicator comprising a fluid reservoir and a nib;

said fluid applicator further comprising a valve assembly for controlling the release of fluid, the valve assembly being biased towards its closed position, the valve assembly being engaged to the nib extending out of an end portion of the fluid applicator, the nib being engaged with the valve assembly so that when a pressure is exerted on the end of the nib in a direction toward the reservoir, the valve assembly is moved to its open position to allow fluid to pass out from the fluid applicator; and wherein the cavity of the wide area adapter has a depth selected so that an inner surface of the cavity engages the end of the nib so as to apply a pressure on the end of the nib when the end portion of the fluid applicator is detachably received in the cavity, the pressure on the nib moving the valve assembly to its open position to allow the passage of fluid.

16. The wide area applicator as claimed in claim 15, wherein the porous pad and the holder portion both have the shape of an elongated rectangle with rounded ends.

17. The wide area applicator as claimed in claim 15, wherein the porous pad has a height, width, and depth, and wherein the porous pad has an elongated shape such that the length of the pad's greatest dimension is at least four times the length of the pad's second greatest dimension.

18. The wide area applicator as claimed in claim 15, wherein the fluid applicator comprises an end portion which is removably attached to the reservoir to facilitate refilling the reservoir with coating fluid.

19. The wide area applicator as claimed in claim 15, wherein the fluid applicator comprises an end portion which is removably attached to the reservoir using a threaded screw-on configuration.

20. The wide area applicator as claimed in claim 15, wherein the porous pad comprises a strip of felt that has a length of at least two inches, and a height and depth of no more than one half of one inch each at any point.

* * * * *